US005702180A

United States Patent [19]

Huang

[11] Patent Number: 5,702,180

[45] Date of Patent: Dec. 30, 1997

[54] TABLE LAMP

[76] Inventor: Chih-Sung Huang, 19, Lane 111, Hoping Road, Louchou, Taipei, Taiwan

[21] Appl. No.: 805,908

[22] Filed: Mar. 4, 1997

[51] Int. Cl.[6] ..... F21S 1/12

[52] U.S. Cl. ..... 362/410; 362/414; 362/806

[58] Field of Search ..... 362/351, 410, 362/411, 414, 294, 373, 457, 806

[56] References Cited

U.S. PATENT DOCUMENTS

| | | | |
|---|---|---|---|
| 4,509,105 | 4/1985 | Short, Jr. | 362/414 |
| 4,998,193 | 3/1991 | Chuing-Hui | 362/414 |
| 5,420,773 | 5/1995 | Huang | 362/410 |

*Primary Examiner*—Y My Quach
*Attorney, Agent, or Firm*—Bacon & Thomas

[57] ABSTRACT

A table lamp comprises a lamp stand comprising a pair of identical truncated cones, wherein one of the two truncated cones is oppositely engaged with the other, a truncated cone shaped lamp shade for being fitted into the top of the lamp stand bottom, and a bulb socket assembly comprising a socket, a ring and a light bulb wherein the socket is inserted from the bottom of one truncated cone through the central hole thereof and the corresponding central hole of the other truncated cone, thereby the female screw thread of the ring cooperates with the male screw thread of the socket for threadly securing the socket and two truncated cones.

2 Claims, 3 Drawing Sheets

TABLE LAMP

FIELD OF THE INVENTION

The present invention relates to a table lamp and, more particularly, to a detachable and portable table lamp which is easy to assemble as well as space saving for storage and transportation.

BACKGROUND OF THE INVENTION

Table lamps are widely used in rooms and offices. A table lamp generally comprises a stand on which a bulb socket is mounted, wherein the socket is electrically connected to an external power source by way of a power cable, and a light shade used to diffuse light. Conventionally, lamp shade and stand are fixed in shape so as to occupy large space, and since they are sturdy they are difficult to transport.

The present invention can advantageously overcomes the above drawbacks of prior art by providing a detachable and portable table lamp.

SUMMARY OF THE INVENTION

It is therefore an object of the present invention to provide a table lamp comprising a lamp stand which including a pair of identical truncated cones, wherein one truncated cone is oppositely engaged with the other truncated cone; a truncated cone shaped lamp shade directly fired onto the upper one of the two truncated cones; and a bulb socket assembly having a threaded bore used to threadedly secure a bulb. The bulb socket inserts from the lower truncated cone through a central hole of one truncated cone and a central hole of the other truncated cone and mounted to the junction surfaces thereof. A ring threadly secures to the bulb socket thereby the bulb socket assembly and lamp stand are firmly in place.

It is another object of the present invention to provide a table lamp, wherein a hole formed on the the bottom of the peripheral surface of each of the two truncated cones and two buckles formed on the edge of the hole wherein one buckle extends outwardly toward a corresponding buckle such that the power cable is able to be secured there.

The above and other objects, features and advantages of the present invention will become apparent from the following detailed description taken with the accompanying drawings.

DETAILED DESCRIPTION OF THE PREFERRED EMBODIMENTS

Figure 1:
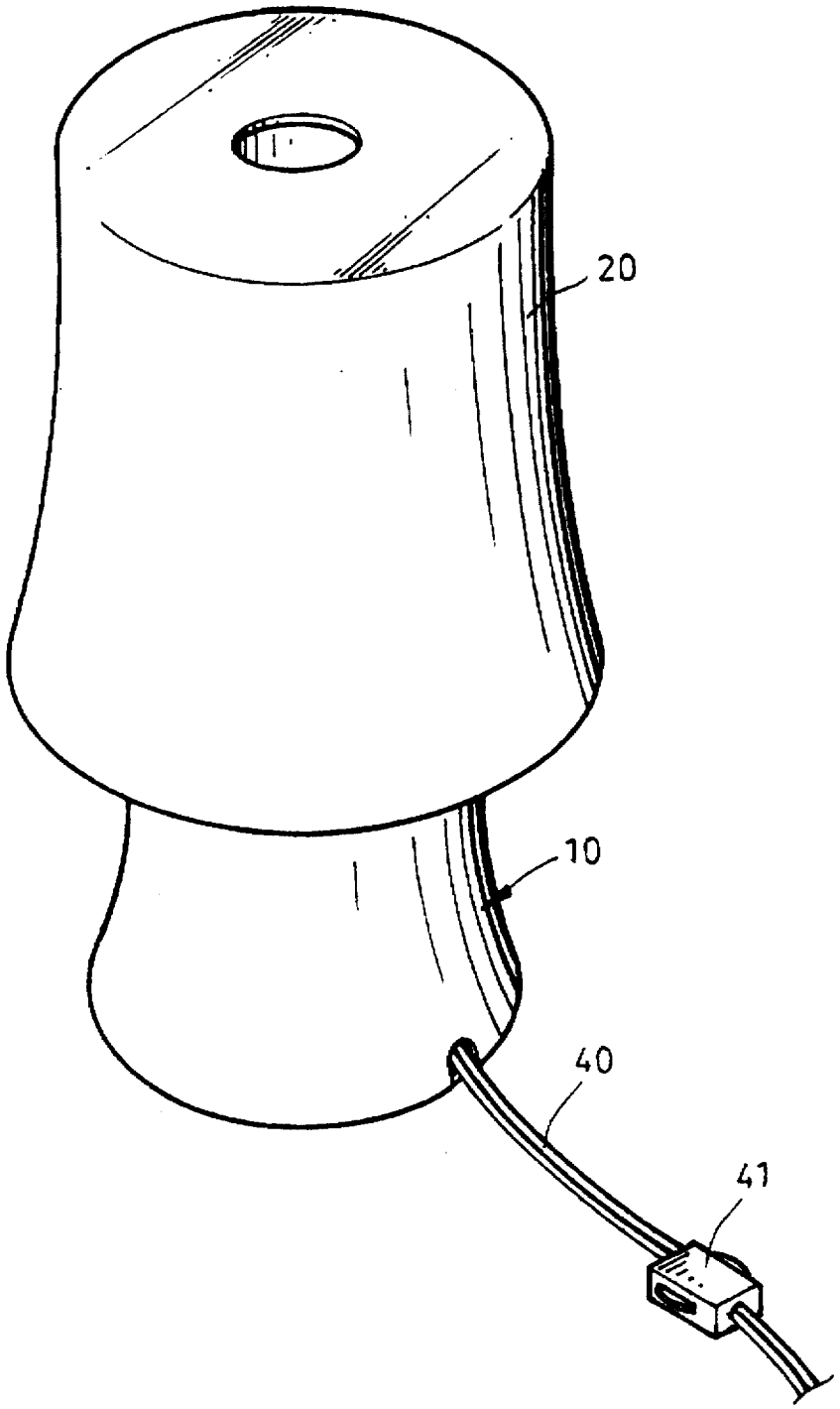
FIG. 1 is a perspective view of a table lamp of the present invention.
Figure 2:
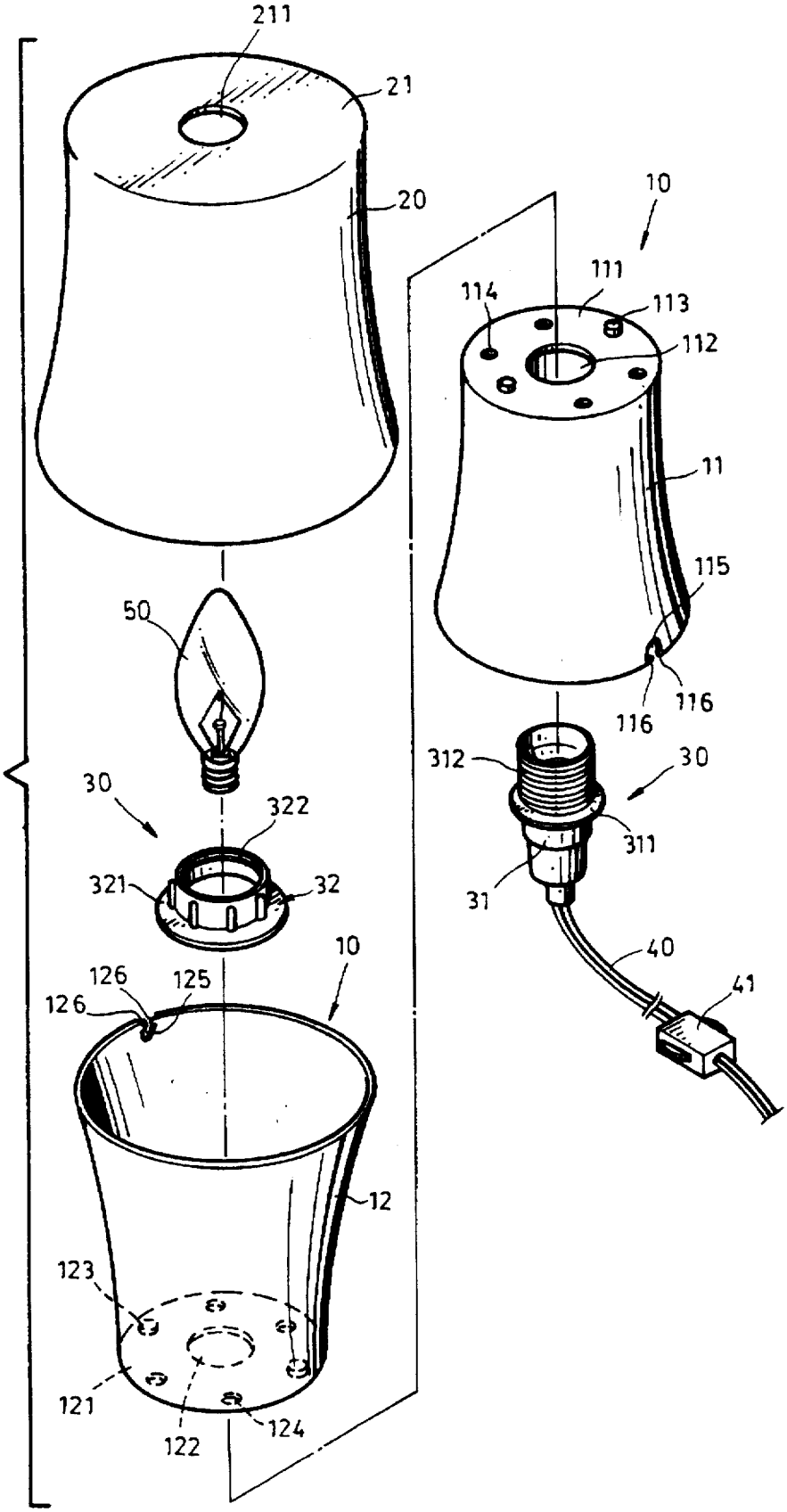
FIG. 2 is an exploded view of the table lamp of FIG. 1.
Figure 3:
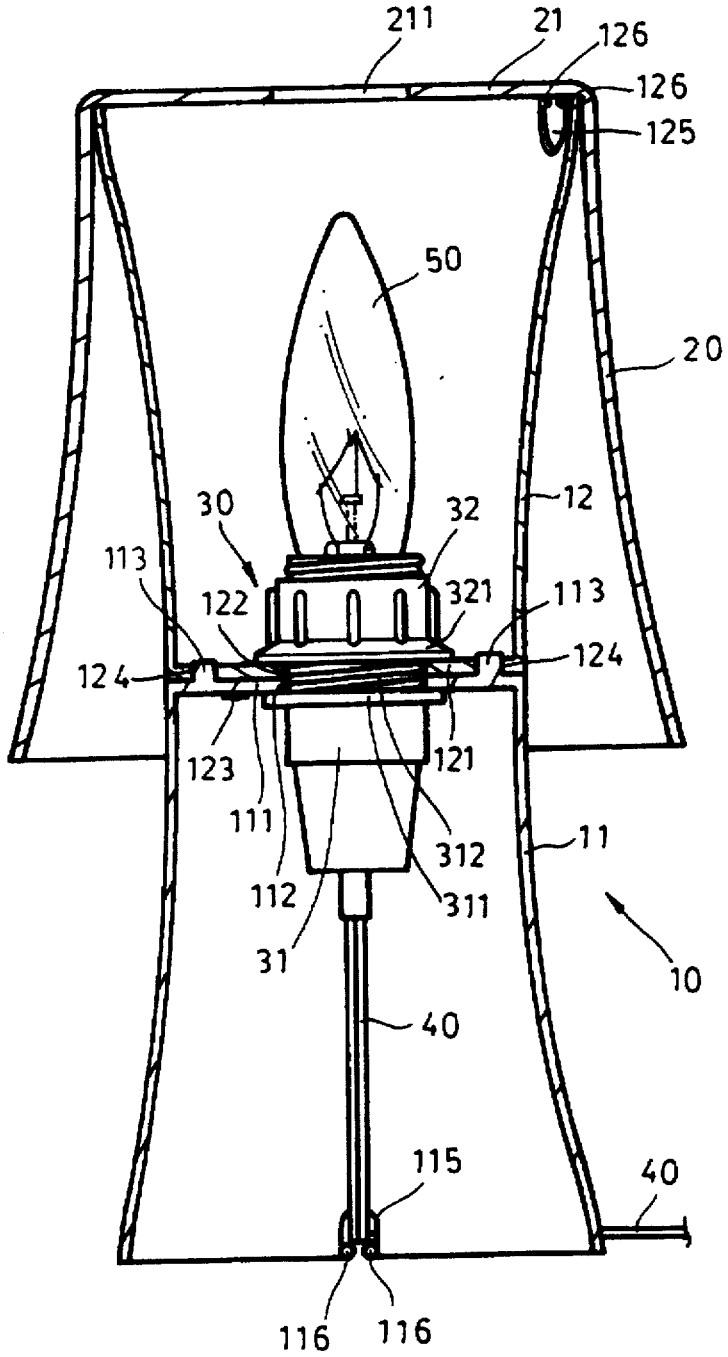
FIG. 3 is a sectional view of the table lamp of FIG. 1.

Referring to FIG. 1–3, a table lamp comprises a lamp stand 10, a lamp shade 20, and a bulb socket assembly 30. The lamp stand 10 comprises a pair of identical truncated cones 11 and 12, wherein one of the two truncated cones 11 and 12 is oppositely engaged with the other. The truncated cones 11 and 12 are made of transparent material. The peripheral surfaces of the truncated cones 11 and 12 are curved which extends from the top slightly outwardly to the bottom. The top of the truncated cones 11 and 12 are junction surfaces 111 and 121. The center of the junction surfaces 111,121 are central holes 112 and 122. A plurality of raised portions 113 and recessed portions 114 and a plurality of raised portions 123 and recessed portions 124, which equidistantly spaced each other are formed around the central holes 112 and 122 respectively. When two truncated cones 11 and 12 engage oppositely, a plurality of raised portions 113 and recessed portions 114 of the junction surface 111 firmly secure to the corresponding raised portions 124 and raised portions 123 of the junction surface 121, as illustrated in FIG. 3. Two holes 115 and 125 form on the bottom of the truncated cones 11 and 12 respectively. As shown, a buckle 116 extends outwardly toward a corresponding buckle 116, and a buckle 126*a*, such that the power cable 40 is able to be secured there.

Lamp shade 20 is made of transparent material. The lamp shade 20 is also a truncated cone wherein the peripheral surface of lamp shade 20 is curved which extends from the top slightly outwardly to the bottom. The diameter of the top of the lamp shade 20 substantially conforms to the diameter of the top of the truncated cones 11 and 12 of the lamp stand 10 as shown in FIG. 3. There is a top surface 21 formed on the top of the lamp shade 20. There is a central hole 211 substantially formed on the center of the top surface 21. The central hole 211 serves as a light passage and a way to dissipate heat.

The bulb socket assembly 30 comprises a socket 31, a ring 32 and a light bulb 50. A predetermined length of power cable 40 extends from the bottom of the socket 31 through the hole 115 and secured there by two buckles 116. The power cable 40 connects to an external power source. A switch 41 is provided on the power cable 40 for turning on/off the table lamp. A circumferential flange 311 is substantially located on the center of the outer surface of the socket 31. A male screw thread 312 is provided from the circumferential flange 311 to the top of the outer surface of the socket 31. A ring 32 has a circumferential flange 321 formed on the bottom and a female screw thread 322 formed on the inner surface. The socket 31 is inserted through the central hole 112 of the junction surface 111 of the lower truncated cone 11 and the central hole 122 of the junction surface 121 of the upper truncated cone 12. Then, the female screw thread 322 of the ring 32 cooperates with the male screw thread 312 of the socket 31 for threadly securing the socket 31, lower truncated cone 11, and upper truncated cone 12. At this point, the light bulb 50 fits into the socket 31. Finally, the lamp shade 21 fits onto the upper truncated cone 12 such that the assembly is finished. The disassembly of the table lamp can be done in reversed order.

While the invention herein disclosed has been described by means of specific embodiments, numerous modifications and variations could be made thereto by those skilled in the art without departing from the scope of the invention set forth in the claims.

I claim:

1. A table lamp, comprising:

a lamp stand comprising a pair of identical truncated cones, wherein one of the truncated cone is oppositely engaged with the other truncated cone and a peripheral surface of each of the truncated cones is curved which extends from a top of the truncated cone slightly outwardly to a bottom, and the top of each of the truncated cones is a junction surface, wherein a center of each of the junction surfaces is a central hole, and a plurality of raised portions and recessed portions formed on each of the junction surfaces respectively, when the truncated cones engage each other oppositely, the plurality of raised portions and recessed portions of the junction surface of one truncated cone firmly secure to the corresponding raised portions and raised portions of the junction surface of the other truncated cone;

a bulb socket assembly comprising a socket, a ring and a light bulb, wherein a predetermined length of power cable extends from a bottom of the socket through a hole of the truncated cone and secured there by two buckles of the truncated cone, and connects to an external power source, a switch provided on the power cable for turning on/off the table lamp, a circumferential flange is located on an outer surface of the socket, a mate screw thread is provided from the circumferential flange to the top of the outer surface of the socket, the ring has a corresponding circumferential flange formed on a bottom thereof and a female screw thread formed on the inner surface thereof, the socket is inserted through the central hole of the junction surface of the lower truncated cone and the central hole of the junction surface of the upper truncated cone and then the female screw thread of the ring cooperates with the male screw thread of the socket for threadly securing the socket, lower truncated cone, and upper truncated cone; and a truncated cone shaped lamp shade, wherein a peripheral surface of the lamp shade is curved which expands from a top of the shade slightly outwardly to a bottom of the shade and a diameter of the top of the lamp shade substantially conforms to a diameter of the top of each of the truncated cones of the lamp stand, a surface formed on the top of the lamp shade thereby causes the lamp shade fitted onto the lamp stand.

2. The table lamp of claim 1, wherein said hole formed on the the bottom of the peripheral surface of each of the truncated cones and said two buckles formed on an edge of the hole wherein one buckle extends outwardly toward a corresponding buckle such that the power cable is able to be secured therebetween.

* * * * *